United States Patent [19]

Smith

[11] Patent Number: 4,991,776

[45] Date of Patent: Feb. 12, 1991

[54] HIGH VOLUME, LOW PRESSURE SPRAYING SYSTEM

[76] Inventor: William C. Smith, 7701 Whiterim Ter., Potomac, Md. 20854

[21] Appl. No.: 450,474

[22] Filed: Dec. 14, 1989

[51] Int. Cl.[5] ..... B05B 7/24; B05B 7/06; F04B 23/00

[52] U.S. Cl. ..... 239/302; 239/290; 417/76; 417/183; 417/190; 137/895

[58] Field of Search ..... 417/76, 151, 158, 181, 417/182, 183, 184, 190, 191; 239/290, 294, 302, 310, 314, 303, 304, 306, 307, 308; 137/895

[56] References Cited

U.S. PATENT DOCUMENTS

| | | | |
|---|---|---|---|
| 1,125,341 | 7/1912 | King | 417/191 |
| 1,922,920 | 8/1933 | Aherne | 417/183 |
| 2,266,365 | 12/1941 | Harrison et al. | 239/308 |
| 2,767,727 | 10/1956 | Acomb | 417/184 |
| 3,282,227 | 11/1966 | Nielsen | 417/183 |
| 3,529,421 | 9/1970 | Neeley | 417/191 |
| 3,796,376 | 3/1974 | Farnsteiner | 239/416.1 |
| 3,940,065 | 2/1976 | Ware et al. | 239/302 |
| 4,681,372 | 7/1987 | McClure | 417/183 |
| 4,850,809 | 7/1989 | Smith | 417/76 |

*Primary Examiner*—Andres Kashnikow
*Assistant Examiner*—Christopher G. Trainor
*Attorney, Agent, or Firm*—Birch, Stewart, Kolasch & Birch

[57] ABSTRACT

A high volume, low pressure air system for atomizing a fluid, such as paint, includes, among other things, a variable jet venturi induction pump located within a sealed low pressure air tank for holding a relatively large volume of low pressure air generated by the induction pump which is coupled to a source of compressed air as well as ambient air and having a plurality of outlets which are adapted to be coupled to and feed low pressure air for powering a respective plurality of individual atomizing devices, such as spray guns, with the air tank being located a predetermined distance away from the atomizing devices so that overspray produced thereby is prevented from being fed along with the ambient air into the induction pump. The system also controls the supply of compressed air and can be equipped with a compressed air driven intake fan for turbo charging the ambient air fed to the jet venturi induction pump.

25 Claims, 6 Drawing Sheets

HIGH VOLUME, LOW PRESSURE SPRAYING SYSTEM

BACKGROUND OF THE INVENTION

This invention relates generally to the atomization of fluids and more particularly to the high volume, low pressure atomization and entrainment of liquids, such as paint, for application to a surface.

Two types of apparatus for the atomization and particulation of fluids are currently in use, namely pneumatic and airless. As they refer to application of paint type coatings, both types normally comprise high pressure apparatus. However, at least one type of low pressure system is also known and comprises the system disclosed in a recently issued patent granted to the present inventor on July 25, 1989, namely U.S. Pat. No. 4,850,809 entitled, "Air Operated Low Pressure Spraying System". This patent will be discussed hereinafter and is specifically meant to be incorporated herein by reference.

Conventional high pressure, low volume pneumatic systems have the disadvantage of locally producing a wasteful cloud of fluid and air commonly referred to as "overspray". The solvent vapors become part of the atmosphere and present a hazard not only to the environment and user, but also to the atomizing equipment. The visible components of overspray comprise solids entrapped in the vapor which results not only in the degrading of the quality of the work surface, but also in the contamination of the work site. High pressure, airless systems also generate a type of overspray referred to as "bounceback". This condition is created by the high velocity by which the fluid is propelled to the surface. The rebounding particles, solids and vapors, form a cloud similar to the overspray generated by pneumatic apparatus. Both types of systems, however, produce the same undesirable results.

Overspray and its reduction has become a subject of major concern to industries involved in the atomization of fluids. An amendment to the "Clean Air Act" of February, 1987 as it relates to hydrocarbon emission controls, established limitations and standards of performance for fluid transfer. Those industries affected are manufacturers and end users of commercial and consumer solvents, architectural coatings, pesticides, and all apparatus and methods involved in their application. Particular emphasis is being placed on government and military users. Additionally, individual states are implementing this act with their own pollution control bills. In some states, high pressure paint systems and adaptations that rely on high pressure, low volume application of atomization are being studied for restricted use. This could have a disastrous effect on thousands of small businesses. Manufacturers of fluids, in order to reduce the percentage of carrier solvents, are now required to increase their solids content and change fluid chemistry. This places a new burden on the atomizing system to atomize these high solids and viscosities.

All spraying systems require some type of apparatus to atomize the fluid and deliver it to the work surface. This apparatus is commonly called a spray gun. Guns vary in their configuration, size, weight and internal composition. Most attempts at improved fluid atomization for the purposes of spray painting have been, moreover, directed to the gun. One such spray gun, as disclosed in U.S. Pat. No. 3,796,376, granted to I. O. M. Farnsteiner on Mar. 12, 1974, for example, locates a jet venturi induction pump in the handle of the gun. Its failure to achieve commercial acceptability is due to the location of the jet venturi induction pump. Its function was to convert high pressure, low volume shop air to low pressure, high volume air. However, because of its close proximity to the work area, the ambient air drawn into the device was contaminated by overspray. Therefore the jet venturi induction pump was continuously introducing contaminated air into its internals. As a result, this contaminated air left deposits on the internal passages and orifices of the apparatus causing it to malfunction. Additionally, the user's hand could easily block the induction ports preventing a continuous inflow of ambient air. The entire system, as a result, was dominated by shop air. Lastly, the type of apparatus cannot be adjusted to meet varying fluid viscosities. All these adverse conditions negated the role of the device as an acceptable improvement. To successfully atomize conventionally, pressures of 50 to 60 psig at 4 to 8 cfm. are required. The gun is designed to atomize fluids by the violent forward motion of the air as its exits the nozzle. Because the air nozzle is considerably larger than the fluid nozzle, it delivers more air than is necessary. The explosion into the atmosphere results in overspray. Thus, there is a direct relationship between overspray and high pressure.

This led to the development of the high volume, low pressure system disclosed in the present inventor's above referenced U.S. Pat. No. 4,850,809 wherein a portable enclosure is used to house a variable jet venturi induction pump which physically separates the induction pump from the area of application and other potentially contaminating elements. Ambient air remote from the work site is introduced into the portable enclosure after regulation and filtration. A low pressure field for driving a spray gun is generated by the induction pump by increasing the velocity of the air fed into a venturi section of the pump which is free of contaminates generated, for example, by overspray in the vicinity of the area of application.

SUMMARY

Accordingly, it is an object of the invention to provide an improvement in systems for atomizing fluids.

It is another object of the invention to provide an improvement in high volume, low pressure systems for atomizing liquids.

It is a further object of the invention to provide a high volume, low pressure system for feeding low pressure air to a plurality of atomization devices.

It is yet another object of the invention to provide a common high volume, low pressure air supply system for selectively powering a plurality of paint spray guns.

Briefly, the foregoing and other objects are achieved by a high volume, low pressure system for atomizing a fluid, such as paint, and comprising, among other things, a variable jet venturi induction pump located within a sealed air tank for holding a relatively large volume of low pressure air generated by the induction pump and including a plurality of atomizing air outlets which are adapted to couple to and feed low pressure air to a respective plurality of individual atomizing devices, such as spray guns, with the tank being located a predetermined distance away from the atomizing devices so that overspray produced thereby is prevented from being fed into the induction pump along with compressed air from a source of compressed air. The induction pump, moreover, is attached to the walls of a sealed chamber within the tank which draws in and delivers filtered ambient air to an induction port of the pump for feeding ambient air from a normally closed spring biased inlet valve to a venturi section of the pump, which then provides relatively low pressure air which is then stored in the air tank. The spring biased inlet valve of the air induction chamber is opened by a drop in back pressure in the sealed air tank upon activation of an atomizing device coupled to the air tank and which itself also includes a normally closed spring biased valve but which is manually opened, for example, when atomization is desired. Additionally, means are provided, to automatically start and stop the flow of compressed air to the induction pump in response to internal pressure within the sealed chamber in the air tank. Also, means are included for turbo charging the ambient input air fed to the induction pump.

BRIEF DESCRIPTION OF THE DRAWINGS

The following detailed description of the invention is to be considered together with the attached drawings wherein.

DETAILED DESCRIPTION OF THE PREFERRED EMBODIMENTS

Figure 1:
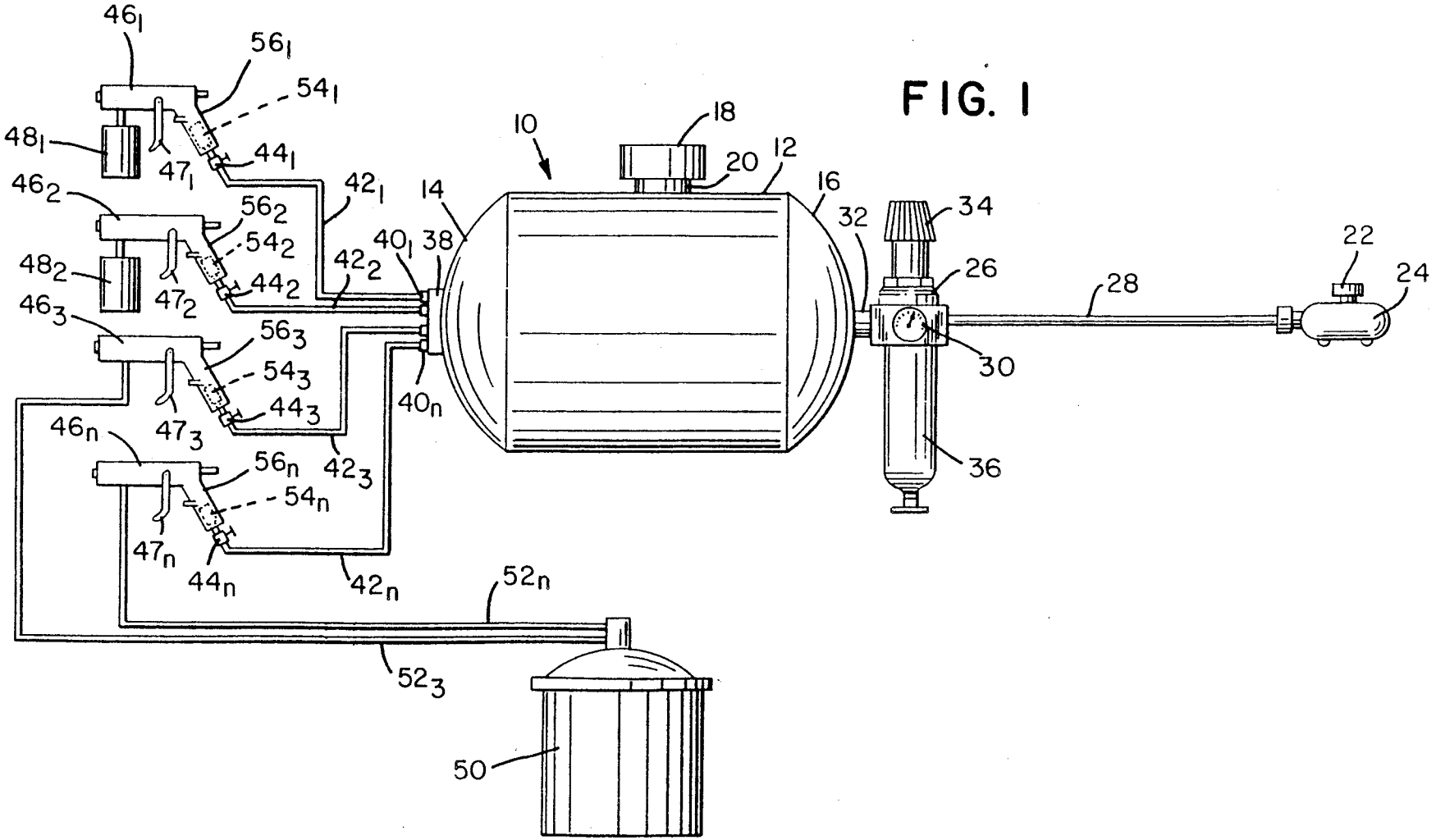
FIG. 1 is a mechanical schematic diagram generally illustrative of the preferred embodiment of the invention.

Referring now to the figures wherein like reference numerals refer to like parts throughout, reference will first be made to FIG. 1 where reference numeral 10 denotes a relatively large sealed tank for storing low pressure air generated therein as will be hereinafter explained. The tank as shown is comprised of an elongated generally cylindrical body 12 having end portions 14 and 16. Further as shown, a filtered ambient air intake assembly 18 including an air filter is attached to an air induction assembly 20 integral with the tank 10 and coupled to an induction port of a variable jet venturi induction pump located interiorally of the tank body 12, the details of which are shown, for example, in FIG. 3, and which will be subsequently described.

Further as shown in FIG. 1, a source of compressed air comprising a self starting and shut-off air compressor 22 comprised of, for example, a Model LT 5008 manufactured by the Campbell-Haysfeld Co. and storage tank 24, is coupled to a pressure regulator 26 via an air hose 28 or other form of conduit. The function of the pressure regulator 26 is to provide the proper air pressure required by the venturi induction pump inside of the tank 10 and to cause the compressor 22 to shut down when compressed air is not required. An indicator 30 is provided to permit the user to adjust the pressure of the compressed air entering the tank 12 via the coupling 32 and which is adjustable by the manually operable knob 34. The pressure regulator 26 is shown also including an air filter 36 attached thereto which is used to decontaminate the compressed air generated from moisture, oil, rust and dirt. When desirable, the filter 36 can be separate from the regulator 26.

At the fore end 14 of the tank 10 there is located a hose coupling manifold 38 having a plurality of quick disconnect connectors 40 for selectively connecting one or more low pressure output air hoses or other flexible conduits thereto. As shown in FIG. 1, a plurality of air hoses $\mathbf{42}_1$, $\mathbf{42}_2$, $\mathbf{42}_3$ and $\mathbf{42}_n$ have manually operable shut-off valves $\mathbf{44}_1$, $\mathbf{44}_2$, $\mathbf{44}_3$, $\mathbf{44}_n$ located at their far or distal ends. The air hoses also include means shown in FIG. 4 for coupling to respective atomizing devices $\mathbf{46}_1$, $\mathbf{46}_2$, $\mathbf{46}_3$, . . . $\mathbf{46}_n$, typically comprising manually operable spray guns connected to a source of fluid or liquid to be atomized and which, for example, may be paint. In the embodiment shown in FIG. 1, two of the paint spray guns $\mathbf{46}_1$ and $\mathbf{46}_2$ are connected to respective paint containing pressure cups $\mathbf{48}_1$ and $\mathbf{48}_2$, while the remaining paint spray guns $\mathbf{46}_3$ and $\mathbf{46}_n$ are coupled to a common source of paint consisting of a pressure pot 50 and which connects to the paint spray guns via paint supply hoses $\mathbf{52}_3$ and $\mathbf{52}_n$.

Figure 4:
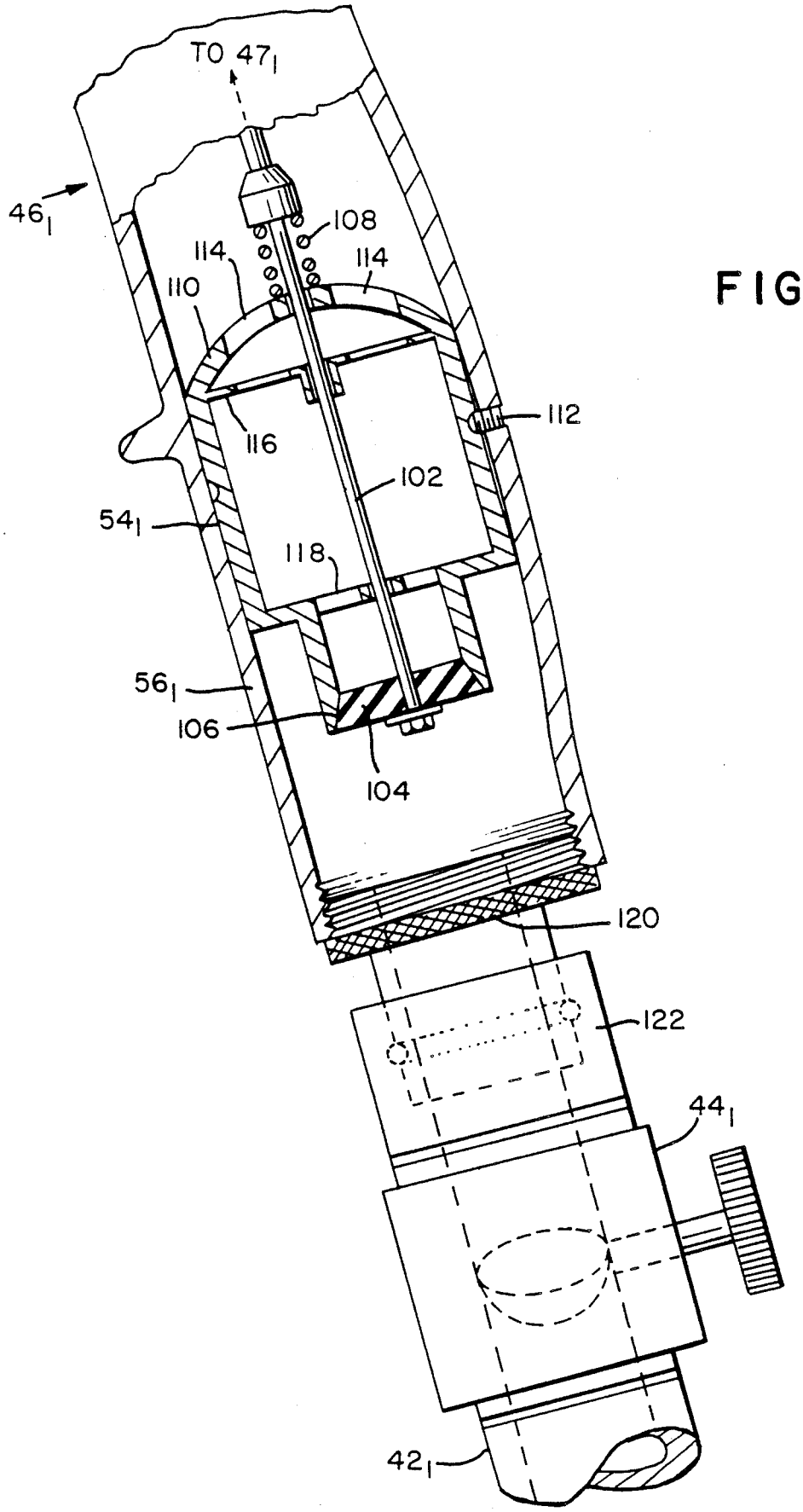
FIG. 4 is a partial longitudinal cross sectional view of a handle of a spray gun shown in FIGS. 1 and 2 and including the details of a low pressure air intake valve therefor.

It should also be pointed out that each of the paint spray guns $\mathbf{46}_1$, $\mathbf{46}_2$, $\mathbf{46}_3$, . . . $\mathbf{46}_n$ include a self-contained trigger operated air feed valve $\mathbf{54}_1$, $\mathbf{54}_2$, $\mathbf{54}_3$ . . . $\mathbf{54}_n$, which are located in the respective handle portions to the gun and which connect to the connector elements, shown in FIG. 4, for coupling to the low pressure feed hoses $\mathbf{42}_1$, $\mathbf{42}_2$, $\mathbf{42}_3$, . . . $\mathbf{42}_n$. The details of one of the valves $\mathbf{54}_1$, for example, are shown in FIG. 4 and will be discussed subsequently.

Figure 2:
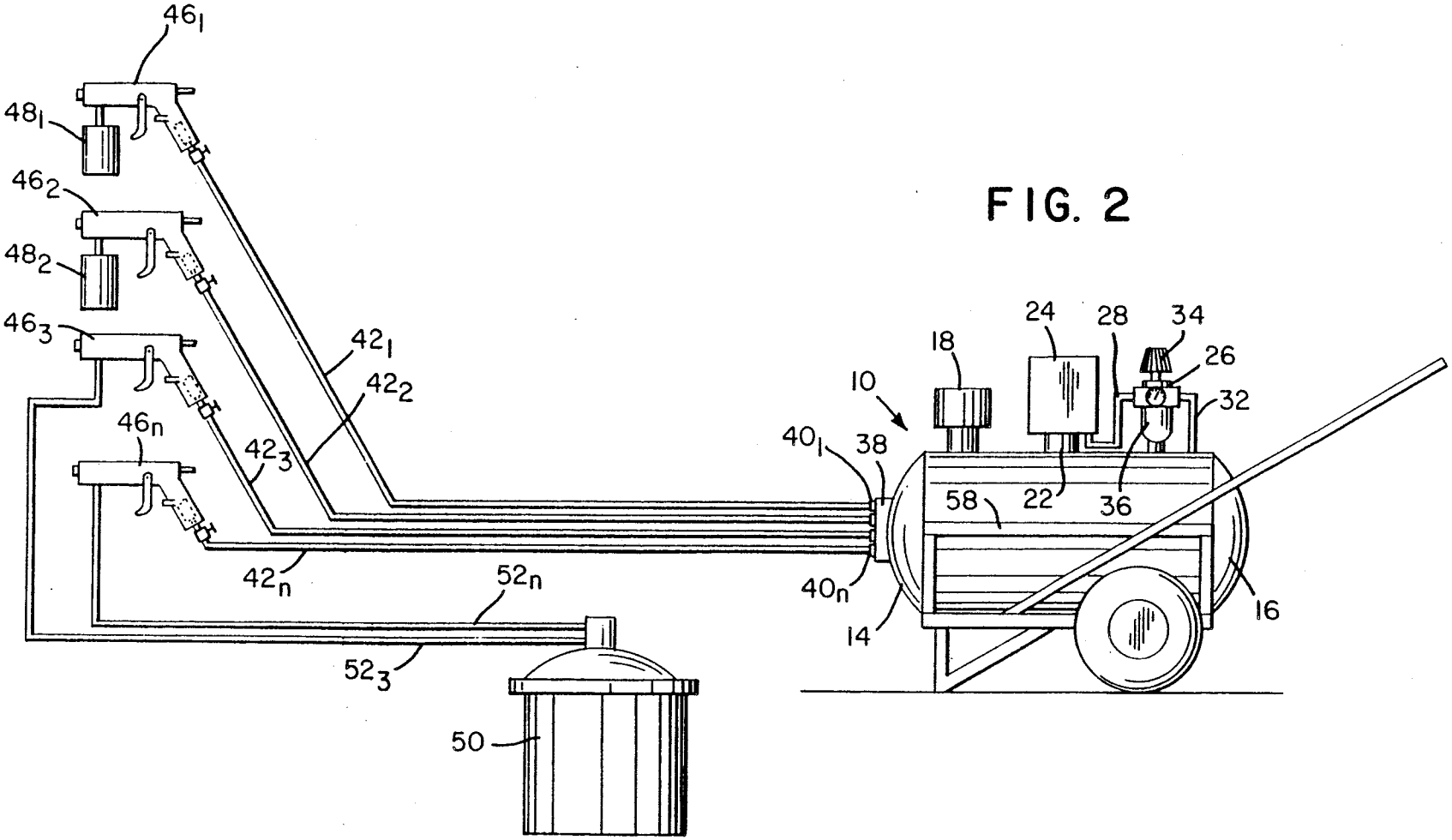
FIG. 2 is a mechanical schematic diagram of a modified embodiment of the invention shown in FIG. 1.

Referring now to FIG. 2, shown thereat is a modification of the system shown in FIG. 1 in that the apparatus including the low pressure tank 10, the regulator 26 and its associated components as well as the air compressor 24 and storage tank 22 therefor are all mounted on a wheeled vehicle, such as a cart, 58 so that the entire assembly for feeding high volume, low pressure air to a plurality of paint spray guns $\mathbf{46}_1$, $\mathbf{46}_2$, . . . $\mathbf{46}_n$, for example, can be quickly and easily moved from place to place upon demand, whereas the configuration shown in FIG. 1, for example, could be a substantially stationary installation where the low pressure storage tank 10 is located remotely from the work station and out of range of a region where overspray may be present. It is the primary objective of both embodiments to remove the ambient air intake which is shown constituting the filter 18, from the immediate vicinity of the spray gun(s).

Figure 3:
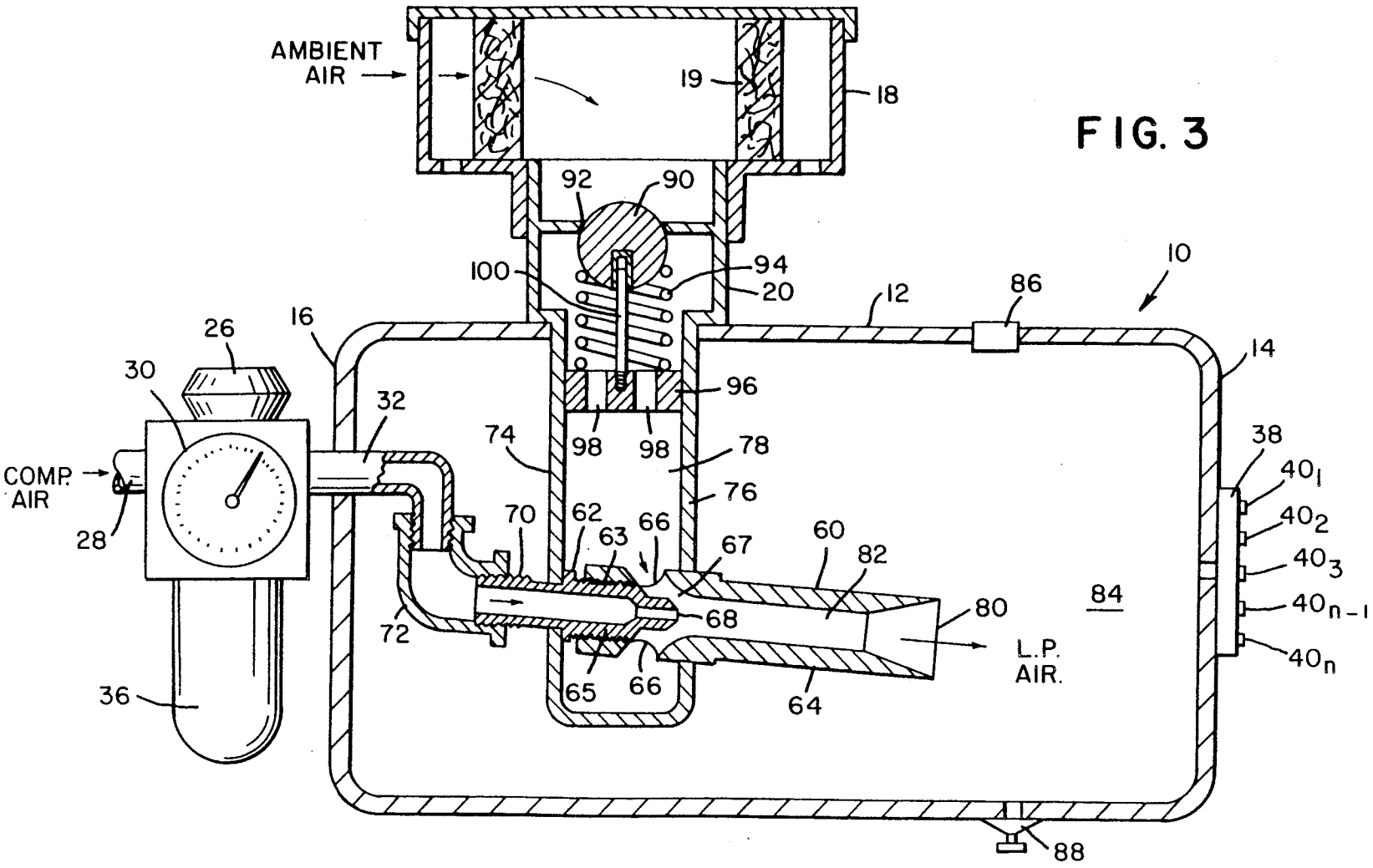
FIG. 3 is a side elevational view partially in section of a jet venturi induction pump and ambient air intake chamber therefor mounted within the low pressure air tank shown in FIGS. 1 and 2.

Proceeding now to FIG. 3, shown thereat are the details of the interior of the source of high volume, low pressure air including the sealed tank 10 shown in FIGS. 1 and 2. Interiorally of the air tank body 12 is located a variable jet venturi induction pump assembly 60 of the type shown and described in the above referenced U.S. Pat. No. 4,850,809. The induction pump 60 comprises a venturi intake nozzle member 62, a throat section member 64 attached to the nozzle 62. The section 64 also includes one or more induction ports 66 and a curved induction passage 67 which are located adjacent the output end 68 of the nozzle 62. The input end 70 of the nozzle 62 is threaded and is attached to a coupling member 72 which attaches to the threaded end of a compressed air output tube 32 from the regulator 26. Both the nozzle 62 and the venturi section 64 of the induction pump assembly 60 are attached to a pair of opposing vertical walls 74 and 76 of a sealed ambient air induction chamber 78. The output end 80 of the venturi section 64 is flared outward and is called the pressure recovery section. Screw threads 63 on the nozzle portion 65 permit adjustability and provide a means for varying the position of the nozzle end 68 in the induction passage 67 for adjusting the induction pump assembly 60 for various different viscosities.

In operation, compressor air from the regulator 26 converges at the output end 68 of the venturi nozzle 62, causing a high velocity output of compressed air to occur, creating a low pressure zone at the induction ports 66. The ambient air mixes with the low pressure compressed air in the downstream section 82 of the throat section 64 where it is delivered at a pressure ranging from 6 to 8 psi into the interior portion 84 of the tank 10 as defined by the dimensions of the tank body 12. This provides a relatively large volume of low pressure air which can be accessed via the manifold 38 and the couplers $40_1 \ldots 40_n$, to which air lines $42_1 \ldots 42_n$ can be attached as required as shown in FIGS. 1 and 2.

A pressure relief poppet valve 86 is also included on the tank housing 12 for safety purposes along with a petcock 88 for removing contaminants therefrom.

The ambient air intake assembly 20 including the sealed chamber 78 and the ambient air intake filter 18 additionally includes a spring biased ball valve 90 which is urged against a valve seat structure 92 by means of a compression spring 94 which contacts the surface of a member 96, which includes a plurality of ambient air delivery ports 98 as well as providing a mounting structure for a support rod 100, upon which the ball valve 90 may freely slide downwardly and upwardly between open and closed positions on the valve seat 92.

Before considering the operation of the apparatus shown in FIG. 3, reference will first be made to FIG. 4 inasmuch as the operation of the ball valve 90 operates in concert with any one of air inlet control valves $54_1 \ldots 54_n$ located in the handles of paint spray guns $46_1 \ldots 46_n$ as shown in FIGS. 1 and 2. In FIG. 4 there is depicted the handle $56_1$ of the paint spray gun $46_1$ and the details of the control valve $54_1$ therein. A finger operated trigger $47_1$ (FIG. 1) of the paint spray gun $46_1$, is mechanically coupled to an elongated valve stem 102 connected at one end to a plunger type valve member 104 which is biased into a normally closed position on the valve seat structure 106 by a compression spring 108 located externally of the valve housing 110 which fits inside of the spray gun handle $56_1$ and is held in position, for example, by a retaining screw 112. The valve body includes a plurality of air outlet ports 114 at the head of the assembly, with the valve rod being stabilized by a pair of internal support members 116 and 118. Thus actuation of the trigger $47_1$ of the spray gun $46_1$ operates to move the valve 104 outwardly away from the seat 106 so that low pressure air entering the bottom end 120 of the handle $56_1$ will pass through the valve housing 110 where it exits the ports 114 and is delivered to the atomizer section of the spray gun $46_1$, not shown.

FIG. 4 also discloses a quick disconnect coupler 122 for connecting the spray gun 46 to the low pressure air feed hose $42_1$ which also includes a manual cut off valve $44_1$, and which is normally closed to prevent the escape of low pressure air from the hose $42_1$ when unconnected from the paint spray gun or when the paint spray gun $46_1$ is not in use while being connected thereto.

Considering the overall operation of the paint spray system thus described and assuming that at least one paint spray gun, for example, the gun $46_1$, is connected to the low pressure air tank 10 via the air supply hose $42_1$ and that the manually operated valve $44_1$ is in the open position, both the ball valve 90 (FIG. 3) and the valve 104 (FIG. 4) will normally be biased closed by their respective bias springs 94 and 108 and no ambient air will be fed to the induction pump 60 via the air induction assembly 20 nor will any low pressure air be fed from the tank 10 to the atomizer portion of the paint spray gun $46_1$. Since the air compressor 24 is of the automatic shut-off type, compressed air fed from the air compressor 24 to the nozzle 62 of the venturi pump 60 will also stop. However, triggering of the paint spray gun $46_1$ causes the valve 104 in the handle to open, which results in the back pressure in the tank 10 being reduced. This enables the ball valve 90 to open against the pressure of the spring 94 and compressed air will be fed to the nozzle 62 due to the action of the regulator 26 on the compressor 22. Upon release of the triggering mechanism $47_1$ in the spray gun $46_1$, the valve 104 returns to its closed position and the back pressure in the tank again increases to force the ball valve 90 against its valve seat 92, thus preventing any further ambient air from being fed to intake ports 66 of the induction pump 60. This also causes the regulator 26 to signal the air compressor 24 to stop pumping air.

Figure 5:
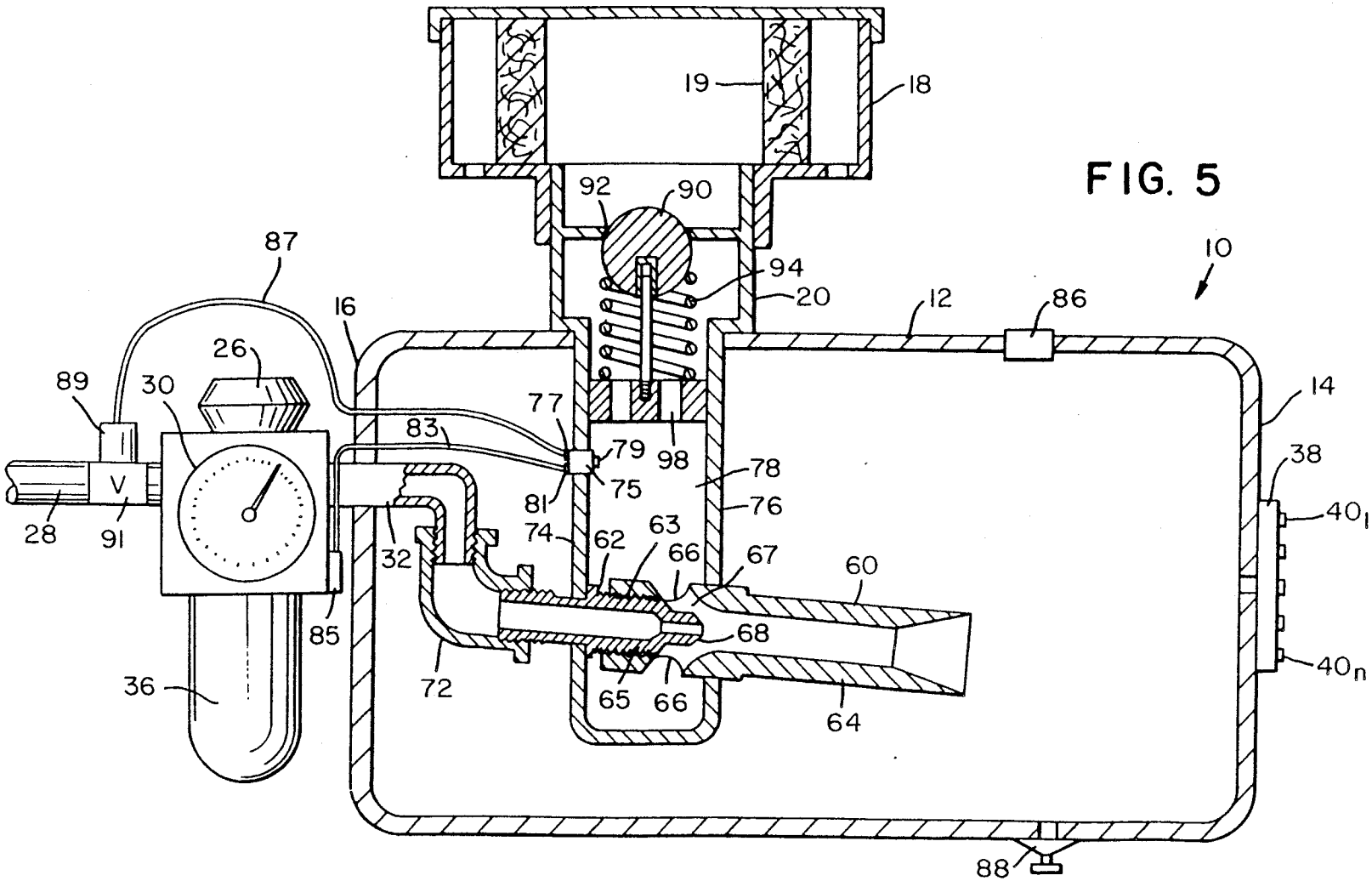
FIG. 5 is a side elevational view partially in section of a modified form of the tank shown in FIG. 1 including means for controlling the flow of compressed air from the air compressor shown in FIGS. 1 and 2.

Considering now the embodiment of the invention shown in FIG. 5, shown thereat is a means for automatically controlling the supply of compressed air to the induction pump 60 in response to the pressure inside of the sealed chamber 78. As shown, a pressure sensor device 75 is mounted in the wall 74 of the chamber 78. The sensor 75 is in the form of a pressure repeater which opens and closes a pressure output port 77 depending upon whether or not the sensed pressure sensed at the input port 79 is above or below an adjustable reference pressure applied to a second input port 81. A pressure repeater is a well known device, a typical example being Model Number 1043 Pressure Repeater, manufactured by the Clippard Instrument Laboratory, Inc.

Further, as shown, the reference pressure input port 81 is coupled via tube 83 to an adjustable miniature pressure regulator 85. The miniature pressure regulator is coupled to the pressure sensed by the indicator 30 for providing a visual indication of the value of compressed air to be used as the reference pressure applied to the sensor 75. The sensed pressure input port 79 is in communication with the interior of the ambient air inlet chamber 78. The output port 77 is coupled via tube 87 to a pilot actuator 89 which controls a valve 91 connected in the compressed air line 28 upstream from the regulator 26.

Accordingly, the valve 91 operates to enable or inhibit flow of compressed air from the compressor 22 and the tank 24 as shown, for example, in FIG. 1 to the venturi nozzle 62 in response to the internal pressure in the ambient air intake chamber 78.

Figure 6:
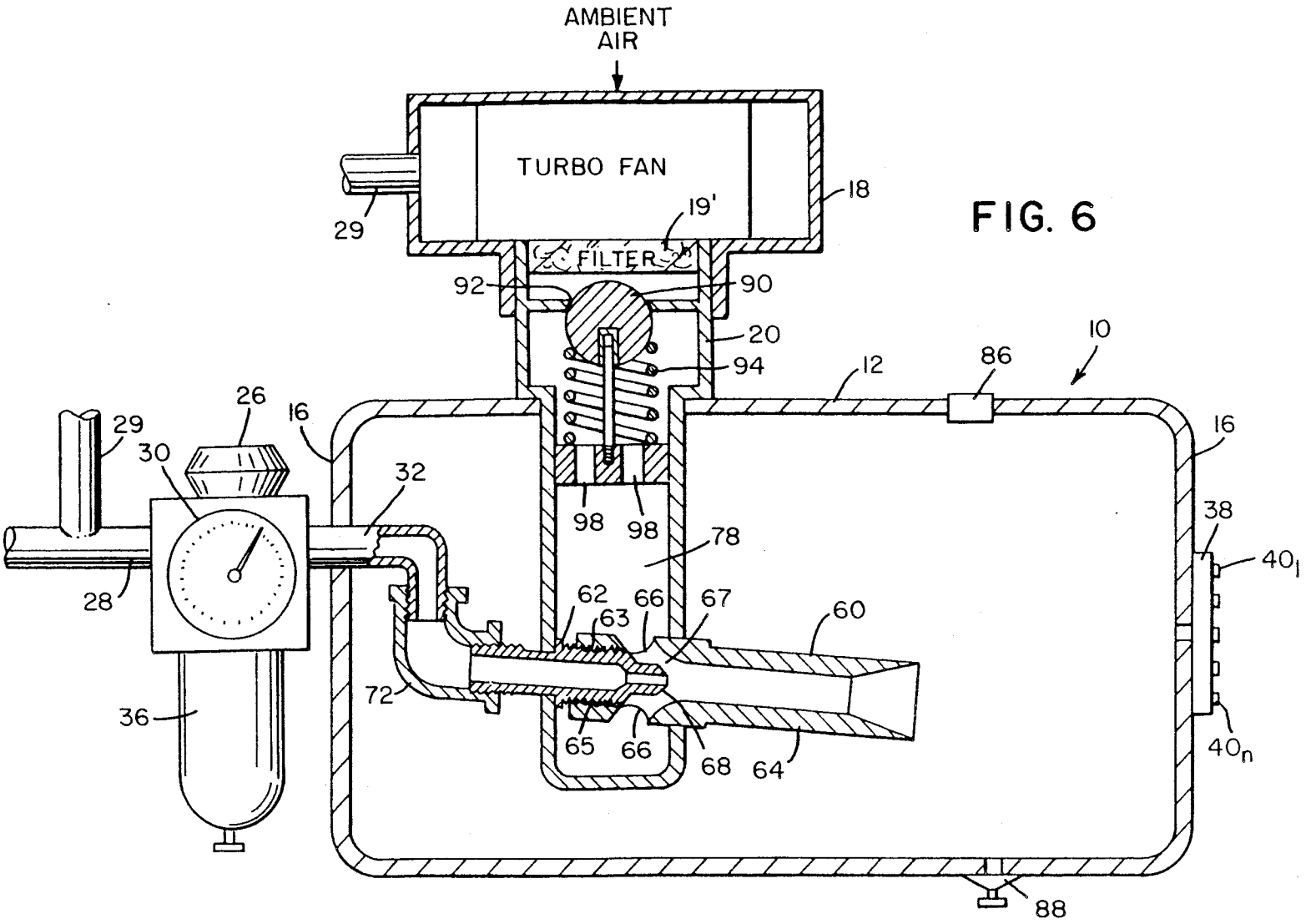
FIG. 6 is a side elevational view partially in section and being illustrative of a modification of the ambient air intake assembly for providing a compressor driven turbo powered input of ambient air to the jet venturi induction pump shown in FIG. 3.

Referring now to FIG. 6, shown thereat is a turbocharged embodiment of the subject invention wherein a turbo fan 17, for example, is located in the ambient air intake housing 18. As shown, a turbo fan 17 is located within the housing 18 which previously included the air filter 19 as shown in FIG. 3 and is powered by compressed air from the compressor 22 by means of an air hose or conduit 29 coupled to the compressed air feed hose 28. With the introduction of the turbo fan 17, the ambient air is fed into the top of the housing 18'. The air delivered to the venturi induction pump 60 is still filtered prior to the location of the ball valve 90 and comprises mounting an air filter 19' at the top portion of the ambient air input assembly 20. In such a configuration, substantially more air can be fed to the induction port 66 of the venturi induction pump 60 when the ball valve 90 is moved to the open position, thus increasing the usable volume of low pressure air by the spray guns $46_1 \ldots 46_n$.

Thus what has been shown and described is an improvement in high volume, low pressure atomization apparatus which is particularly suited for spray paint applications and where a variable jet venturi induction pump utilized to generate low pressure air for powering the atomizers, e.g. paint spray guns, is located in a sealed enclosure apart from and at a predetermined distance away from the paint spray gun(s) so that overspray produced thereby is prevented from being fed into the induction pump along with compressed air from a compressed air source.

Having thus shown and described what is at present considered to be the preferred embodiments of the invention, it should be noted that the same has been made by way of illustration and not limitation. Accordingly, all modifications, alterations and changes coming within the spirit and scope of the invention as set forth in the appended claims are herein meant to be included.

I claim:

1. A high volume, low pressure atomization system, coupled to a compressed air source, for atomizing a fluid, comprising:

at least one atomizer including means for being coupled to a source of fluid to be atomized;

a jet venturi induction pump including a nozzle and a venturi section, said venturi section having an input end, an output end, and induction port means located at said input end adjacent said nozzle;

means for coupling the nozzle to said compressed air source;

a sealed enclosure having an air chamber including a manifold for storing and delivering low pressure air, said manifold further including a plurality of outlets for the selective coupling of low pressure air to said at least one atomizer for powering said atomizer, and an ambient air inlet assembly secured to said enclosure and including an air induction chamber projecting into said air chamber for supporting said induction pump therein and having ambient air intake means for receiving ambient air in the vicinity of said enclosure, said induction port means being located inside of said air induction chamber for receiving ambient air from said intake means, and said output end being located outside of said air induction chamber for feeding low pressure air generated thereby into said air chamber, said enclosure being located apart from and at a predetermined distance away from said at least one atomizer so that overspray produced thereby and present in the ambient air in the vicinity thereof is prevented from being fed into said air intake means and said venturi induction pump along with compressed air from said compressed air source.

2. The system as defined by claim 1 wherein said ambient air intake means includes filter means for filtering the ambient air received thereby.

3. The system as defined by claim 2 wherein said ambient air intake means includes valve means biased in a normally closed position but which is moved to an open position to deliver ambient air to said induction port means when said at least one atomizer is activated.

4. The system as defined by claim 3 wherein said valve means comprises a spring biased valve.

5. The system as defined by claim 4 wherein said biased valve is located between said filter means and said induction port means of said induction pump.

6. The system as defined by claim 3 wherein said at least one atomizer also includes valve means biased in a normally closed position when deactivated, but being moved to an open position to deliver low pressure air to said atomizer when activated.

7. The system as defined by claim 6 wherein said at least one atomizer comprises a paint spray gun.

8. The system as defined by claim 7 wherein said paint spray gun includes manual activator means coupled to said valve means.

9. The system as defined by claim 7 and further comprising air conduit means coupling said at least one atomizer to one of said plurality of outlets on said manifold.

10. The system as defined by claim 9 wherein said air conduit means includes a manually operable shut-off valve.

11. The system as defined by claim 6 wherein said at least one atomizer comprises a plurality of atomizers selectively coupled to said plurality of outlets included on said manifold.

12. The system as defined by claim 11 wherein said plurality of atomizers comprises a plurality of paint spray guns coupled to said plurality of outlets on said manifold, each said gun including said valve means, said valve means comprising an air inlet control valve for delivering the low pressure air to said gun thereof when activated.

13. The system as defined by claim 2 wherein said jet venturi induction pump comprises a variable jet venturi pump.

14. The system as defined by claim 13 wherein said variable jet venturi pump includes means for varying the position of said nozzle relative to said induction port means.

15. The system as defined by claim 14 wherein said induction port means includes at least one induction port and an induction passage leading into the input end of the venturi section and wherein said means for varying the position of the nozzle comprises means for moving the nozzle axially in said induction passage.

16. The system as defined by claim 2 and further comprising means for transporting said sealed enclosure from place to place upon demand.

17. The system as defined by claim 16 wherein means for transporting comprises a wheeled vehicle including means for mounting said sealed enclosure thereon.

18. The system as defined by claim 2 and further comprising means for controlling the flow of compressed air from said compressed air source to said nozzle of said venturi induction pump in response to the air pressure of ambient air in said air inlet assembly.

19. The system as defined by claim 18 wherein said means for controlling the flow of compressed air includes a control valve connected to said means for coupling the nozzle to said compressed air source and means responsive to the pressure of the ambient air in said air induction chamber for controlling said control valve.

20. The system as defined by claim 19 wherein said means responsive to pressure includes means for providing a reference pressure and means for sensing pressure in said air induction chamber and comparing the sensed pressure and the reference pressure to generate a control parameter for controlling said control valve.

21. The system as defined by claim 20 and wherein said control parameter comprises a control pressure and additionally including pressure activated means responsive to said control pressure connected to said control valve for operating said control valve.

22. The system as defined by claim 2 and further comprising means for enhancing the flow of ambient air inside said ambient air inlet assembly.

23. The system as defined by claim 22 wherein said means for enhancing flow comprises turbo charging means located in said ambient air intake means of said ambient air inlet assembly.

24. The system as defined by claim 23 wherein said turbo charging means includes means for being powered by said compressed air source.

25. The system as defined by claim 24 wherein said turbo charging means is located externally of said filter means.

* * * * *